United States Patent [19]

de la Roche Kerandraon

[11] 4,102,293

[45] Jul. 25, 1978

[54] DEVICE FOR PROPELLING SHIPS

[75] Inventor: Olivier Geoffroy de la Roche Kerandraon, Paris, France

[73] Assignee: Societe d'Etude et de Gestion des Brevets de la Roche Kerandraon et de Saulces de Freycinet "S.E.G.", France

[21] Appl. No.: 808,393

[22] Filed: Jun. 20, 1977

[30] Foreign Application Priority Data

Jul. 29, 1976 [FR] France ..... 76 23269

[51] Int. Cl.[2] ..... B63H 1/30

[52] U.S. Cl. ..... 115/28 R

[58] Field of Search ..... 115/28 R-33, 115/76, 21; 416/83; 417/436; 60/221-222

[56] References Cited

U.S. PATENT DOCUMENTS

| | | | |
|---|---|---|---|
| 813,430 | 2/1906 | Hunter | 115/28 R |
| 2,726,624 | 12/1955 | Raicy | 115/32 |
| 3,307,358 | 3/1967 | Kerandraon | 115/31 |
| 3,765,175 | 10/1973 | Ohnaka | 115/28 R |

FOREIGN PATENT DOCUMENTS

| | | | |
|---|---|---|---|
| 477,143 | 1914 | France | 416/83 |
| 986,221 | 3/1965 | United Kingdom | 115/28 R |

*Primary Examiner*—Trygve M. Blix
*Assistant Examiner*—Jesus D. Sotelo
*Attorney, Agent, or Firm*—Steinberg & Blake

[57] ABSTRACT

The invention concerns a device for propelling ships comprising at least one surface which freely oscillates within a casing under the action of at least one shaft. The surface includes a main blade actuated by the shaft and a smaller leading blade connected to the main blade while providing a free space between the two blades.

8 Claims, 7 Drawing Figures

DEVICE FOR PROPELLING SHIPS

The present invention relates generally to the propulsion of ships or like water craft and has more particularly for its object an improved propelling device of the type comprising essentially an open-ended casing or housing mounted under the hull of a ship or like vessel and within which is provided a surface, plate or the like adapted to be actuated in to-and-fro movement while at the same time freely oscillating to ensure the propulsion of the said ship.

Propelling devices complying with the above general definition have already been known for some time. Mention can be made, in this respect, of U.S. Pat. No. 3,307,358 disclosing such a propelling device.

More specifically, there is described in the said patent a propelling device comprising essentially a surface accommodated in a casing or housing immersed in a fluid, the said casing or housing comprising an inlet port and an outlet port for the said fluid, as well as an upper wall and a lower wall between which the said surface is subjected to a to-and-fro movement while at the same time freely oscillating in the fluid owing to a driving shaft connected to the said surface by a movable joint.

Now the Applicant has found that such a propelling device is far from providing the performances and advantages that were expected, and this for the following essential reasons.

The surface actuated in a reciprocating movement in the fluid does not actually constitute a gliding wing, i.e. a wing that assumes its best fineness ratio according to the advance of the ship. This is due to the fact that the surface is not strictly free. Indeed, although the rotation of the said surface about its movable joint with the drive or propelling shaft is free, such a surface has, in principle, no freedom of movement in the vertical direction, this being due to the pounding or ramming motion imposed by the said shaft.

This motion imposed upon the wing, which therefore constitutes an impedement to its freedom of movement in the vertical direction, has a certain number of drawbacks, especially at large angles of incidence of the wing. Thus, when the wing flattens out again after a dive, there may occur an effect that forces the fluid forward, i.e. in the direction opposite to the direction of advance of the ship, which of course adversely affects the desired performances. On the other hand, it has been observed that the propelling devices of the prior art are particularly noisy and that the contact of the oscillating surface with the walls of the casing should be reduced as much as possible.

The purpose of the present invention is more specifically to remedy the above-mentioned drawbacks by providing an improved propelling device whose performances and reliability are greatly improved as compared with the devices of the prior art.

In order to accomplish these purposes, the invention provides a new structure of the oscillating surface constituting a real gliding wing. Otherwise stated, the said wing, owing to its structure, oscillates within the fluid with a maximum degree of freedom in the vertical direction despite the pounding or ramming law imposed by the driving shaft, which, as mentioned earlier, is of course indispensable.

More specifically, the invention has for its object an improved propelling device for ships or like vessels or water craft, of the type comprising at least one surface accommodated in a casing or housing immersed in a fluid and comprising an inlet port and an outlet port for the fluid as well as a lower wall and an upper wall between which the said surface is subjected to a to-and-fro movement while at the same time freely oscillating owing to at least one driving shaft connected to the said surface by a movable joint, characterized in that the said surface is constituted by a main blade or wing actuated by the said shaft and located in the outlet-port side of the casing or housing, the said main blade being connected to at least one small leading blade located in the inlet-port side of the casing or housing, a free space being provided between the said main blade and the said small leading blade.

According to another feature of the invention, the said main blade constitutes two thirds of the length of the said surface, and the free space together with the small leading blade constitute the remaining third of the said length, whereas the point of application of the drive shaft is provided substantially at the main blade end adjacent to the said free space.

It is therefore already understood that the inventive idea is based on the fact that the front one-third surface is minimized with respect to the rear two-third surface, owing to the provision of a free space which remedies the above-mentioned drawbacks.

According to still another feature of the invention, the small leading blade is mounted stationarily or movably in rotation on uprights, rods or the like connecting them to the main blade.

Such a leading blade advantageously serves as an end damper, so that the main blade can receive the best desired profile. In other words there is no longer an important contact between the blade and the lower and upper walls of the casing or housing at the end of the pounding or ramming, but a hydraulic damping or absorption of the impact by the whole surface of the small leading blade. This advantageously imparts to the propelling device the desired noiseless operation.

According to another feature of the invention, a linkage system is associated with the drive shaft, the said linkage system advantageously constituting a parallel motion for piloting the said leading blade so as to maintain the latter in substantially parallel relationship to the lower and upper walls of the casing whatever the inclination of the main blade.

According to one form of the embodiment, the main wing is rigidly connected to two superposed small leading blades braced or tied by rods, bars or the like.

According to still another feature of the invention, at least those ends of the lower and upper walls of the casing that are located on the fluid inlet-port side comprise a bevelled portion, the profile of which corresponds substantially to that of the small leading blade.

The lower wall of the casing may be provided with a proximity detector arranged in the region of the said leading blade.

According to another feature of the invention, the leading blade has a cross section in the shape of an isosceles triangle with a rounded base, which base is located in the inlet-port side of the casing.

Other purposes and advantages of the invention will appear more clearly from the following detailed description made with refernce to the appended drawings given solely by way of example and wherein.

Figure 1:
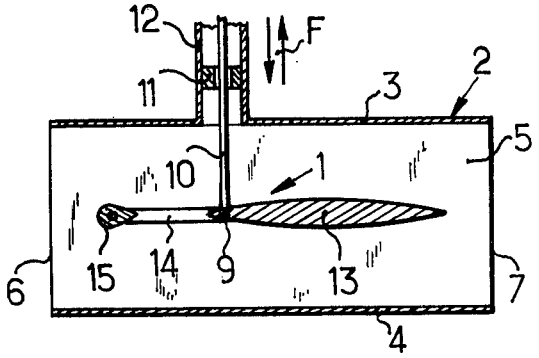
FIG. 1 is a diagrammatic cross-sectional view of a propelling device according to one form of emodiment according to the invention.

The propelling device represented in FIG. 1 is essentially constituted by a surface 1 which can be imparted a reciprocating motion within a casing or housing 2 in the shape of a rectangle parallelepiped, comprising an upper wall 3 and a lower wall 4 as well as two side walls such as 5. The casing 2 is open at both ends 6 and 7 so as to provide an inlet port and an outlet port, respectively. The surface 1 is connected by a movable joint 9 to the end of actuating shafts 10 imparting thereto a vertical reciprocating motions as shown by the double arrow F. The shaft 10 may be for example slidingly mounted in a bearing 11 located in a sleeve 12 secured, e.g. welded, on the upper wall 3 of the casing or housing 2. A to-and-fro movement may be imparted to the shaft 10 by an appropriate device (not shown) such as for example an eccentric device driven in rotation by a motor as described for example in U.S. Pat. No. 3,307,358. It can besides be said in this respect that the to-and-fro movement imparted to the shaft 10 can be obtained in a great number of other ways, as is known in the art.

Besides all of the arrangements described above form part of the prior art and need no detailed description. The specific arrangements forming the subject matter of the present invention will therefore be described now.

The surface 1, according to the present invention and as appears clearly from the drawings, realizes a gliding wing in the aeronautical sense of the word and is constituted by a main blade 13 actuated by the shaft 10 (FIG. 1) and located within the outlet-port side of the casing 2, the said main blade 13 being rigidly connected by rods, side straps or the like 14 to a smaller leading blade 15 located within the inlet-port side 6 of casing 2.

Figure 2:
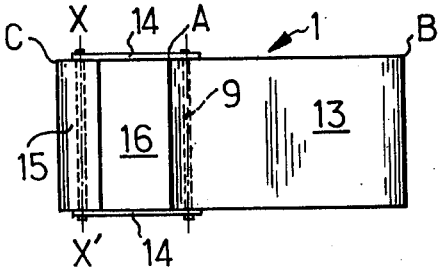
FIG. 2 is a top view of the oscillating surface.

As appears clearly from FIG. 2, a free space 16 is left between the main blade 13 and the smaller leading blade 15. According to the invention, the length AB of the main blade 13 represents two thirds of the total length BC of surface 1, the free space 16 together with the leading blade 15 constituting of course the remaining third of the said length. According to a preferred form of embodiment, the point of application 9 of the shaft 10 is provided at that end of the main blade 13 which is adjacent to the free space 16, as seen clearly in FIG. 2.

It is therefore observed that according to the structure of the blade 1 of the invention, the whole of the active supporting surface is located rearwards of the pounding point 9, whereas the corrective gliding surface constituted by the smaller blade 15 is offset forwardly and without continuity with the main surface 13.

The smaller leading blade 15, according to one form of embodiment, may be mounted stationarily on the side straps 14. According to another form of embodiment, the small blade 15 may be mounted movably on the said side straps, which means that, in this case, the blade 15 can freely rotate about the axis of rotation X,X' indicated in FIG. 2.

Figure 3:
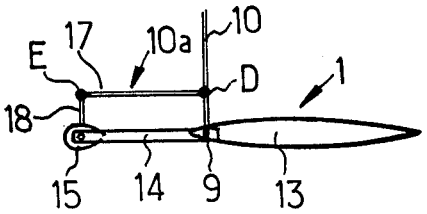
FIG. 3 is a diagrammatic elevational view of the oscillating surface, blade or wing of FIG. 2, which blade is equipped with actuating means constituting a parallel motion.
Figure 4:
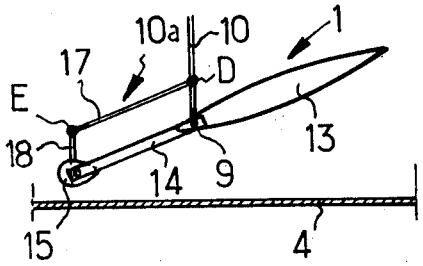
FIG. 4 is a view identical with that of FIG. 3 but showing the blade at a certain angle of incidence within the casing.

As appears clearly from FIG. 3 and according to a preferred form of embodiment, the smaller blade 15 may kinematically piloted by a linkage system 10*a* constituting a parallel motion, the sides of which are constituted respectively by the side strap or link 14, a portion of the shaft 10, a rod or the like 17 connected by a rotary joint D to the shaft 10 and another rod 18 connected on the one hand at E to the rod 17 and on the other hand to the smaller blade 15. Such a parallel motion offers the advantage of maintaining the blade 15 in substantially parallel relationship to the lower wall 4 and the upper wall 3 of the casing whatever the inclination of the main blade 13, as appears clearly from FIG. 4. In this manner there is no point contact between the front end of the surface 1 and the lower or upper wall of the casing at the end of the pounding. In other words a hydraulic damping of the impact takes place over the whole surface of the small blade 15 which, on the other hand, contacts the wall very gently.

Figure 5:
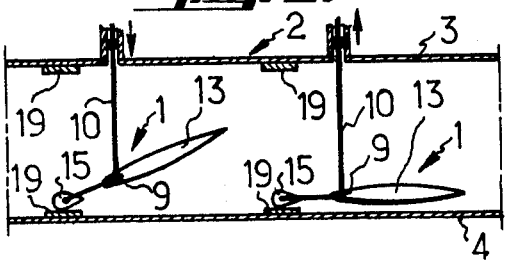
FIG. 5 is a diagrammatic cross-sectional view of a casing containing two blades according to FIG. 2.

It is possible to couple, preferably in series, two surfaces or gliding wings or blades 1 such as described previously within one and the same casing or housing 2, as appears in FIG. 5. In such an arrangement there are advantageously provided, in the region of each small blade 15, proximity detectors 19 mounted on the walls 3 and 4 of the casing 2. Thus, as seen in the Figure, when the small blade 15 associated with the left-hand blade 1 is close to the lower wall 4, the detector causes the pounding of the shaft 10 to stop and simultaneously causes the actuating shaft of the right-hand blade 1 to start. The right-hand blade therefore rises within the casing, whereas the left-hand blade assumes a substantially horizontal position, and the left-hand blade may re-start when the leading blade associated with the right-hand reaches a point in proximity of a detector such as 19 arranged in the upper wall 3 of the casing 2. Of course the detectors 19 control appropriate logic means ensuring the desired synchronization of the operation of the two blades within the casing. It will be noted that the device according to FIG. 5 operates in a particularly noiseless manner, since the selected distances at which the stopping action of the detectors 19 takes place are sufficiently great to avoid any noise which would otherwise be caused by the impact of the blade on the lower and upper walls.

Figure 6:
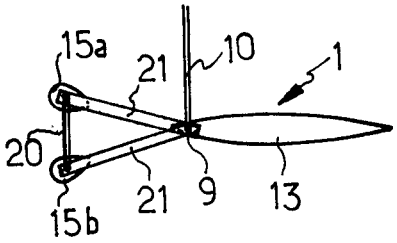
FIG. 6 is a diagrammatic elevational view of another form of embodiment of the blade according to the invention.
Figure 7:
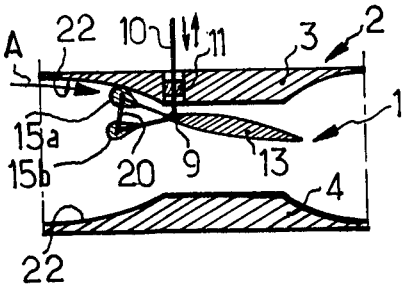
FIG. 7 is a diagrammatic cross-sectional view of the blade of FIG. 6 mounted within a casing or housing of an appropriate type.

According to another form of embodiment and as appears in FIGS. 6 and 7, the main blade 13 is rigidly connected to two superposed smaller blades 15*a*, 15*b* braced or tied by bars or the like 20. At 21 are shown bars or rods connecting the end of the main blade 13 to the smaller blades 15*a*, 15*b* which, in this form of embodiment, are stationary and constitute, in a way, a biplane. As seen in FIG. 7, there is provided a casing 2 having a particular shape adapted to the blade represented in FIG. 6. Indeed, the ends of the lower and upper walls 4 and 3 of the casing 2 that are at the inlet-port side of the latter display a bevelled portion 22 whose profile corresponds substantially to that of the smaller blades 15*a*, 15*b*. In this manner the smaller blade 15*a*, or 15*b* is always tangent to the internal surface of the walls and can efficiently fulfill its function of hydraulic damper. Moreover, it will be observed that when the blade 1 is in the position shown in FIG. 7, the smaller blades follow exactly the incoming water lines (materialized by arrow A) and therefore offer no resistance or reaction against these water lines. As a result, the blade represented in FIG. 6 can operate at a high frequency without any risk of deterioration due to the impact of the blade on the casing walls. Moreover, the angle of incidence of the blade can be important without however adversely affecting its reliable operation owing to the bevelled shape of the casing ends.

According to the invention the smaller blades 15 in the various forms of embodiment illustrated have a cross section in the shape of a drop of water or more precisely or an isosceles triangle with a rounded base, which base is directed towards the inlet port 6 of the casing 2.

The invention therefore provides an improved propelling device, the performances and noiseless operation of which are remarkable. More specifically, such a device offers the following advantages:

- the impacts of the leading edge of the blade on the upper and lower walls of the casing are reduced to a minimum and even suppressed;
- more important specific thrusts can be obtained by a gain on the incidence of the main blade, and there is obtained
- a very smooth operation of the blade, even at high frequency, the said blade being really a gliding wing.

Of course the invention is by no means limited to the forms of embodiment described and illustrated which have been given by way of example only. Thus, there can be provided on the main blade various means such as fins or the like subjecting the said blade to self-sustained secondary oscillations that add to the primary oscillations imparted by the actuating shaft and improve, in a way, the gliding of the blade or wing in the fluid. The invention therefore comprises all technical equivalents to the means described as well as their combinations should the latter be carried out according to its gist and used within the scope of the following claims.

What is claimed is:

1. In a propelling device for ships or any other vessels or watercraft, comprising at least one surface accommodated within a casing or housing immersed in a fluid and provided with an inlet port and an outlet port for the fluid as well as a lower wall and an upper wall between which the said surface is subjected to a to-and-fro movement while at the same time being allowed to freely oscillate under the action of at least one actuating shaft connected to the said surface by a movable joint, the improvements consisting in that the said surface is constituted by a main blade or wing actuated by the said shaft and located within the outlet-port side of the said casing, the said main blade being connected to at least one smaller leading blade located within the inlet-port side of the said casing, a free space being provided between the said main blade and the said smaller blade, at least the lower wall of the casing being provided with a proximity detector arranged in the region of the said smaller blade.

2. A device according to claim 1, wherein the said main blade constitutes two thirds of the length of the said surface, and the said free space together with the said smaller blade constitutes the remaining third of the said length, and the point of application of the said shaft is provided substantially at the main-blade end adjacent to the said free space.

3. A device according to claim 1, wherein the said smaller blade is mounted stationarily on rod means connecting it to the main blade.

4. A device according to claim 1, wherein the said smaller blade is rotatably mounted on rod means connecting it to the said main blade.

5. A device according to claim 4, wherein the said shaft is associated with a linkage system constituting a parallel motion for piloting the said smaller blade so as to maintain the latter in substantially parallel relationship to the lower and upper walls of the said casing whatever the inclination of the main blade may be.

6. A device according to claim 4, wherein the said smaller blade has a cross section in the shape of an isosceles triangle with a rounded base, the said base being directed towards the inlet port of the casing.

7. A device according to claim 1, wherein at least those ends of the lower and upper walls of the casing that are at the inlet-port side of the latter have a bevelled portion, the profile of which substantially corresponds to that of the said smaller blade.

8. In a propelling device for ships or any other vessels or water craft, comprising at least one surface accommodated within a casing or housing immersed in a fluid and provided with an inlet port and an outlet port for the fluid as well as a lower wall and an upper wall between which the said surface is subjected to a to-and-fro movement while at the same time being allowed to freely oscillate under the action of at least one actuating shaft connected to the said surface by a movable joint, the improvements consisting in that the said surface is constituted by a main blade or wing actuated by the said shaft and located within the outlet-port side of the said casing, the said main blade being connected to at least one smaller leading blade located within the inlet-port side of the said casing, a free space being provided between the said main blade and the said smaller blade, the said main blade being connected to two superposed smaller blades braced or tied together by rods, bars or the like.

* * * * *